US009689169B2

(12) United States Patent
Nelson

(10) Patent No.: US 9,689,169 B2
(45) Date of Patent: Jun. 27, 2017

(54) ILLUMINATING A CONCRETE STRUCTURE

(71) Applicant: Richard Nelson, Detroit, MI (US)

(72) Inventor: Richard Nelson, Detroit, MI (US)

( * ) Notice: Subject to any disclaimer, the term of this patent is extended or adjusted under 35 U.S.C. 154(b) by 96 days.

(21) Appl. No.: 14/719,318

(22) Filed: May 22, 2015

(65) Prior Publication Data

US 2016/0017613 A1 Jan. 21, 2016

Related U.S. Application Data

(60) Provisional application No. 62/025,150, filed on Jul. 16, 2014.

(51) Int. Cl.

| | |
|---|---|
| ***F21S 8/00*** | (2006.01) |
| ***E04G 21/00*** | (2006.01) |
| ***F21V 33/00*** | (2006.01) |
| ***G09F 13/22*** | (2006.01) |
| *F21V 19/00* | (2006.01) |
| *F21V 5/04* | (2006.01) |

(Continued)

(52) U.S. Cl.

CPC ..... *E04G 21/00* (2013.01); *F21V 33/006* (2013.01); *G09F 13/22* (2013.01); *E04F 13/141* (2013.01); *E04F 15/08* (2013.01); *F21V 5/048* (2013.01); *F21V 19/002* (2013.01); *F21V 19/005* (2013.01); *F21V 19/0025* (2013.01); *F21W 2121/00* (2013.01); *F21W 2121/004* (2013.01); *F21Y 2101/00* (2013.01); *F21Y 2105/10* (2016.08); *F21Y 2105/12* (2016.08); *F21Y 2115/10* (2016.08); *G09F 2013/222* (2013.01)

(58) Field of Classification Search

CPC ..... E04G 21/00; F21V 33/006; F21V 19/002; F21V 5/048; F21V 19/0025; F21V 19/005; G09F 13/22; G09F 2013/222; E04F 15/08; F21Y 2106/10; F21Y 2105/12; F21W 2121/00; F21W 2121/004

See application file for complete search history.

(56) References Cited

U.S. PATENT DOCUMENTS

| | | | | |
|---|---|---|---|---|
| 5,400,229 A * | 3/1995 | Lin | F21K 9/00 362/249.02 |
| 2004/0119409 A1* | 6/2004 | Kubota | G09F 13/22 313/512 |

(Continued)

*Primary Examiner* — Y M. Lee

(74) *Attorney, Agent, or Firm* — Ash Tankha; Lipton, Weinberger & Husick

(57) ABSTRACT

A method for constructing a concrete structure with light sources embedded therein is provided. An array of light sources with associated circuitry is positioned on a support member. A mold is positioned around the light sources and the associated circuitry on the support member. A binder material is filled in the mold containing the light sources and the associated circuitry on the support member to embed the light sources and the associated circuitry within the binder material. The binder material is allowed to set within the mold containing the embedded light sources and the associated circuitry. The mold and the support member are then removed to obtain the concrete structure embedded with the light sources and the associated circuitry. The embedded light sources illuminate the concrete structure when the embedded light sources are powered on. A decorative upper layer may be created by marbling, veining, etc., in the concrete structure.

19 Claims, 18 Drawing Sheets

(51) Int. Cl.

| | |
|---|---|
| *F21Y 105/12* | (2016.01) |
| *F21W 121/00* | (2006.01) |
| *E04F 13/14* | (2006.01) |
| *E04F 15/08* | (2006.01) |
| *F21Y 101/00* | (2016.01) |
| *F21Y 105/10* | (2016.01) |
| *F21Y 115/10* | (2016.01) |

(56) References Cited

U.S. PATENT DOCUMENTS

2004/0218389 A1* 11/2004 Lamke et al. ..... B60Q 1/2696
362/241
2010/0237369 A1* 9/2010 Wada ..... F21K 9/00
257/98
2012/0065050 A1* 3/2012 Nieminen ..... B44C 5/005
501/32

* cited by examiner

ILLUMINATING A CONCRETE STRUCTURE

CROSS-REFERENCE TO RELATED APPLICATIONS

This application claims priority to and the benefit of provisional patent application No. 62/025,150 titled "Marblite", filed in the United States Patent and Trademark Office on Jul. 16, 2014. The specification of the above referenced patent application is incorporated herein by reference in its entirety.

BACKGROUND

Concrete can be cast in different shapes and sizes to construct architectural concrete structures, for example, buildings, bridges, tunnels, dams, sewerage systems, pavements, runways, roads, products, etc. Moreover, materials such as marbles, stone, bricks, tiles, etc., are widely used in architectural applications, for example, in flooring, walls, driveways, sidewalks, etc. Concrete is economical, non-combustible, requires low maintenance, has a long life, can be molded into any desired shape, is resistant to weather conditions, water, insects, etc. However, concrete lacks aesthetic appeal. The aesthetic appeal of a concrete structure can be enhanced by lighting the concrete structure. Also, while conventional concrete structures offer an adequate aesthetic appearance in day light, their aesthetic appeal can be increased in the dark by illuminating the concrete structure.

Typically, architectural structures are illuminated in dark environments using multiple lighting devices external to the concrete structure, for example, lighting devices installed on ceilings, floorings, walls, driveways, sidewalks, etc., for increasing their aesthetic appeal and for providing light in dark environments. The external lighting devices are typically used in large numbers and are prone to damage.

Hence, there is a long felt but unresolved need for constructing a concrete structure illuminated by light sources, for example, light emitting diodes (LEDs) embedded in the concrete structure to enhance the aesthetic appeal of the concrete structure and provide illumination through lens housings of the embedded light sources when the embedded light sources are powered on, where the lens housings of the embedded light sources protrude above an upper surface of the concrete structure, or in an embodiment, where upper surfaces of the lens housings of the embedded light sources are in a same horizontal plane as the upper surface of the concrete structure.

SUMMARY OF THE INVENTION

This summary is provided to introduce a selection of concepts in a simplified form that are further disclosed in the detailed description of the invention. This summary is not intended to identify key or essential inventive concepts of the claimed subject matter, nor is it intended for determining the scope of the claimed subject matter.

The method disclosed herein addresses the above mentioned need for constructing a concrete structure illuminated by light sources, for example, light emitting diodes (LEDs) embedded in the concrete structure to enhance aesthetic appeal of the concrete structure and provide illumination through lens housings of the embedded light sources when the embedded light sources are powered on, where the lens housings of the embedded light sources protrude above an upper surface of the concrete structure, or in an embodiment, where upper surfaces of the lens housings of the embedded light sources are in a same horizontal plane as the upper surface of the concrete structure. In the method disclosed herein, an array of light sources of a predetermined configuration with associated circuitry is positioned on a support member. Each of the light sources comprises a base and a lens housing in communication with and distal from the base. The array of light sources with the associated circuitry is positioned on the support member with the lens housings of the light sources inserted through perforations configured in the same predetermined configuration in the support member and protruding below a lower surface of the support member, so that the lens housings of the light sources protrude above the upper surface of the constructed concrete structure when the support member is removed. In an embodiment, the array of light sources is positioned on the support member with the upper surfaces of the lens housings of the light sources in the same horizontal plane as an upper surface of the support member, so that the upper surfaces of the lens housings of the light sources in the constructed concrete structure will be in the same horizontal plane as the upper surface of the constructed concrete structure when the support member is removed.

After positioning the array of light sources with the associated circuitry on the support member, a mold is positioned around the positioned array of light sources and the associated circuitry on the support member. A binder material is filled in the mold containing the positioned array of light sources and the associated circuitry on the support member to embed the positioned array of light sources and the associated circuitry within the binder material. The binder material is allowed to set within the mold containing the embedded array of light sources and the associated circuitry. When the binder material is set, the mold and the support member are removed to obtain a concrete structure embedded with the positioned array of light sources and the associated circuitry. The embedded array of light sources illuminates the concrete structure when the embedded array of light sources is powered on. In the constructed concrete structure, the lens housings of the light sources protrude above the upper surface of the concrete structure or, in an embodiment, the upper surfaces of the lens housings of the light sources are in the same horizontal plane as the upper surface of the concrete structure.

In one or more embodiments, related systems include but are not limited to circuitry effecting the methods disclosed herein; the circuitry can be any combination of hardware configured to effect the methods disclosed herein depending upon the design choices of a system designer. Also, various structural elements may be employed depending on the design choices of the system designer.

BRIEF DESCRIPTION OF THE DRAWINGS

The foregoing summary, as well as the following detailed description of the invention, is better understood when read in conjunction with the appended drawings. For the purpose of illustrating the invention, exemplary constructions of the invention are shown in the drawings. However, the invention is not limited to the specific methods and structures disclosed herein. The description of a method step or a structure referenced by a numeral in a drawing is applicable to the description of that method step or structure shown by that same numeral in any subsequent drawing herein.

DETAILED DESCRIPTION OF THE INVENTION

Figure 1:
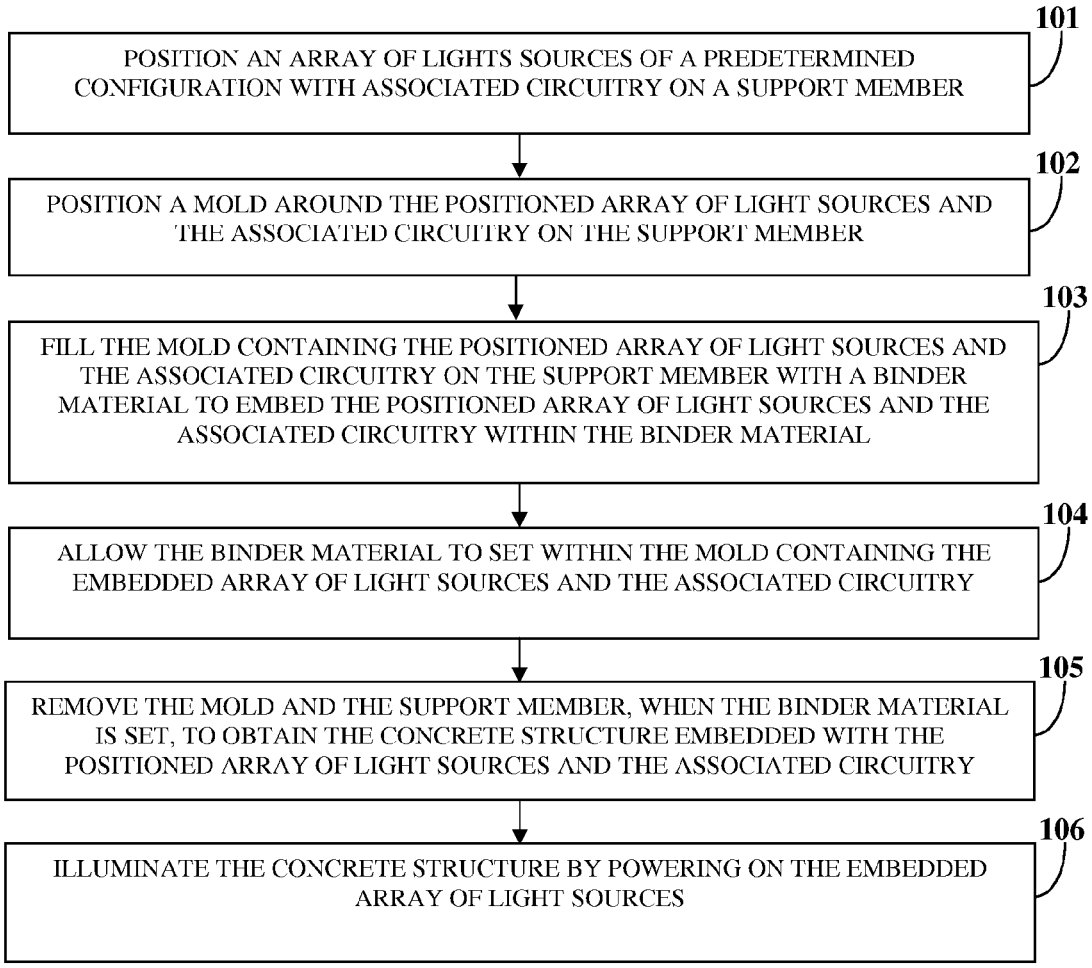
FIG. 1 illustrates a method for constructing a concrete structure illuminated by light sources embedded in the concrete structure.
Figure 3A:
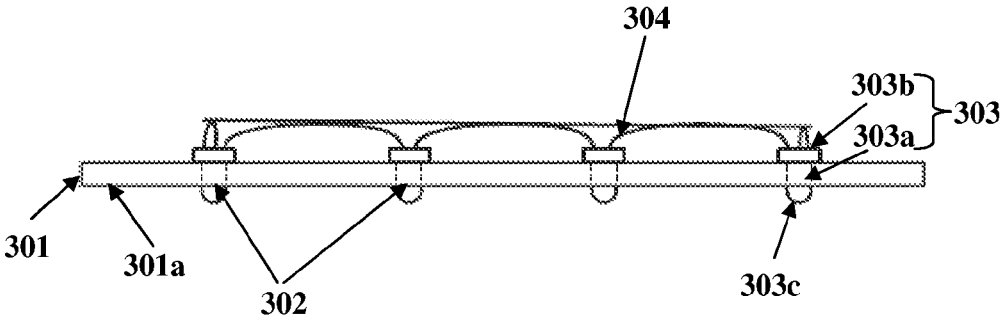
FIGS. 3A-3H exemplarily illustrate construction of a concrete structure with an array of light sources in a rectangular configuration embedded in the concrete structure, where the lens housings of the embedded light sources protrude above the upper surface of the concrete structure.
Figure 6A:
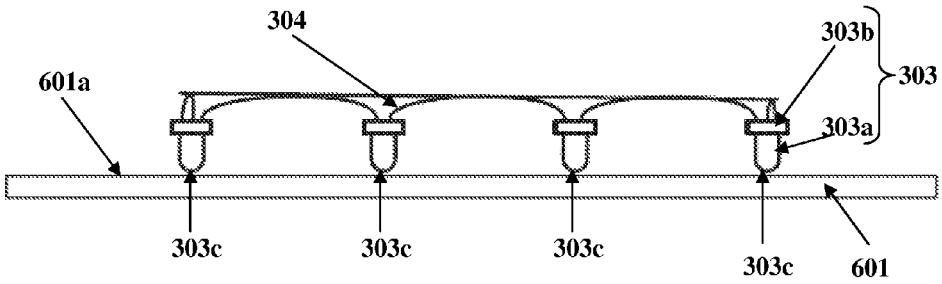
FIGS. 6A-6H exemplarily illustrate construction of a concrete structure with an array of light sources in a rectangular configuration embedded in the concrete structure, where the light sources are recessed within the concrete structure with the upper surfaces of the lens housings of the embedded light sources in the same horizontal plane as the upper surface of the concrete structure.

FIG. 1 illustrates a method for constructing a concrete structure 300 or 400 or 600 or 700 illuminated by light sources 303 embedded in the concrete structure 300 or 400 or 600 or 700 exemplarily illustrated in FIGS. 3G-3H, FIGS. 4B-4C, FIGS. 6G-6H, and FIGS. 7B-7C. As used herein, "concrete structure" refers to a solid structure made of, for example, concrete, cement, marble, a cement composite, a silica composite, etc., and any combination thereof, with light sources 303 embedded in the concrete structure 300 or 400 or 600 or 700 for illuminating the concrete structure 300 or 400 or 600 or 700. Also, as used herein, "light sources" refers to sources or devices that emit light and provide illumination. The light sources 303 comprise, for example, two-lead semiconductor light sources such as light emitting diodes (LEDs) that emit light when powered on. Each of the light sources 303 comprises a base 303*b* and a lens housing 303*a* in communication with and distal from the base 303*b* as exemplarily illustrated in FIG. 3A and FIG. 6A. In an embodiment, the lens housing 303*a* of the light source 303 is a translucent housing made, for example, of an epoxy resin.

In the method disclosed herein, an array of light sources 303 of a predetermined configuration with associated circuitry 304 is positioned 101 on a support member 301 or 601 exemplarily illustrated in FIG. 3B, FIG. 4A, FIG. 6B, and FIG. 7A. As used herein, "predetermined configuration" refers to an arrangement for the array of light sources 303. For example, the light sources 303 are arranged in a rectangular configuration, a square configuration, a circular configuration, a heart shaped configuration, etc. The associated circuitry 304 of the light sources 303 comprises electrical wires, leads of the light sources 303, or fiberglass circuitry. The leads of each of the light sources 303 are connected to assemble the associated circuitry 304 in the predetermined configuration. The associated circuitry 304 that connects the array of light sources 303 further comprises a lead electrical wire (not shown) that is connected to an electrical source, for example, an external power supply unit (not shown) via an electrical plug (not shown) to power on the light sources 303.

Figure 2:
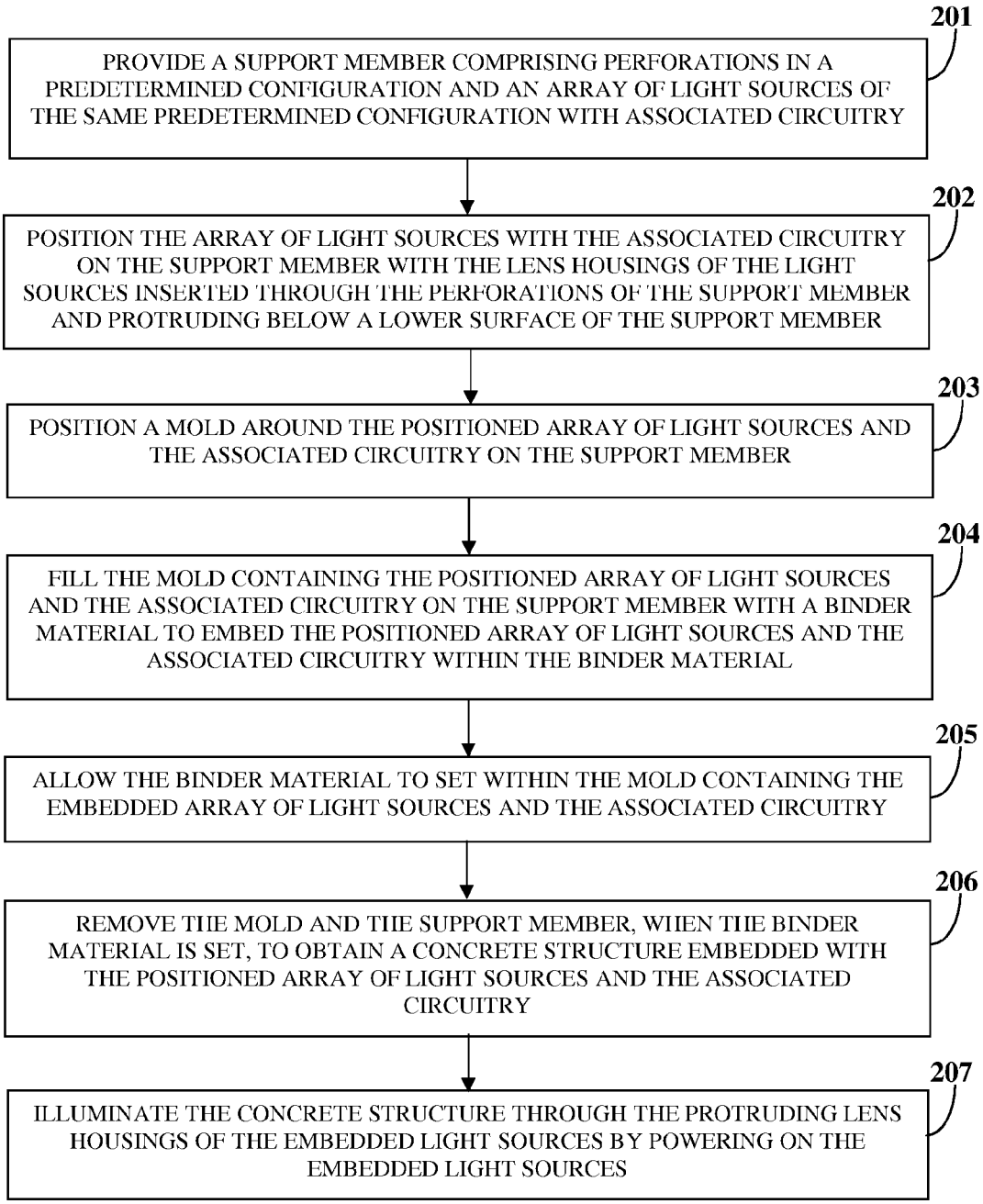
FIG. 2 illustrates a method for constructing a concrete structure with an array of light sources embedded in the concrete structure, where lens housings of the embedded light sources protrude above an upper surface of the concrete structure.
Figure 3B:
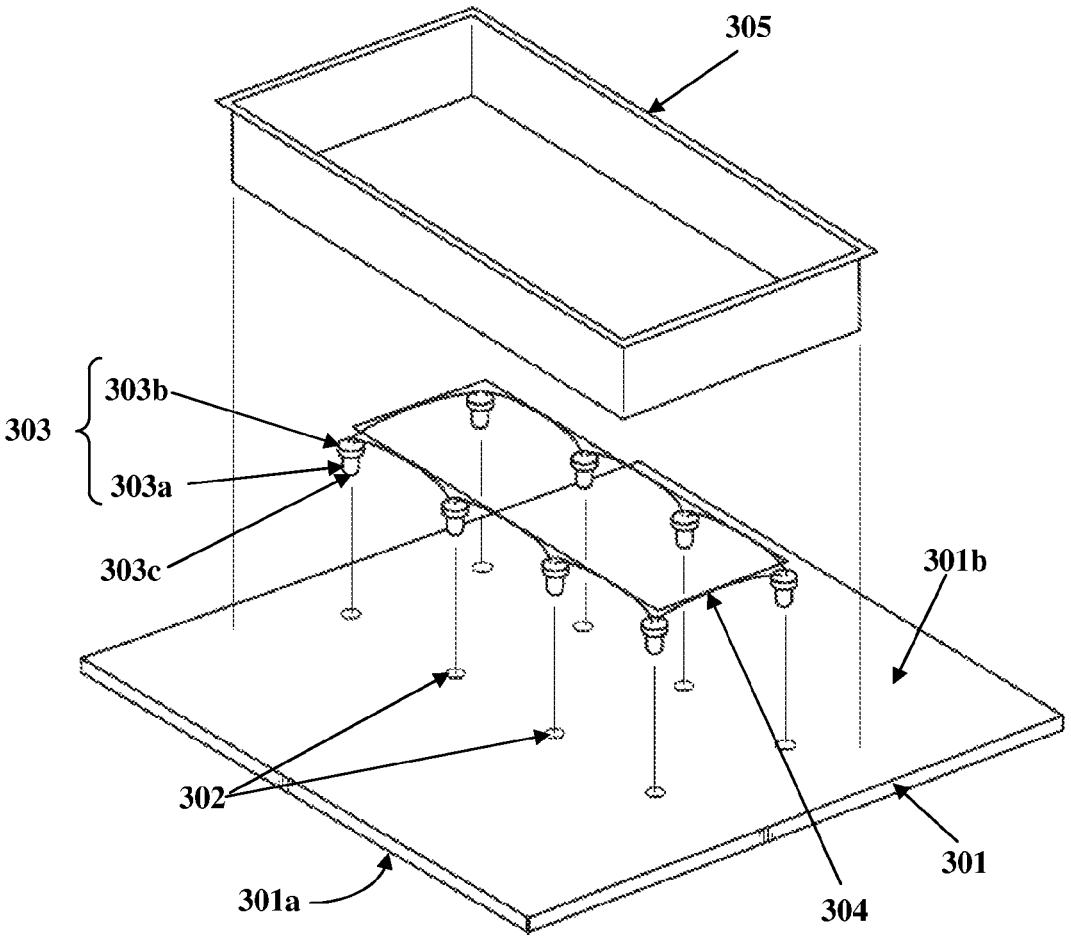
Figure 3C:
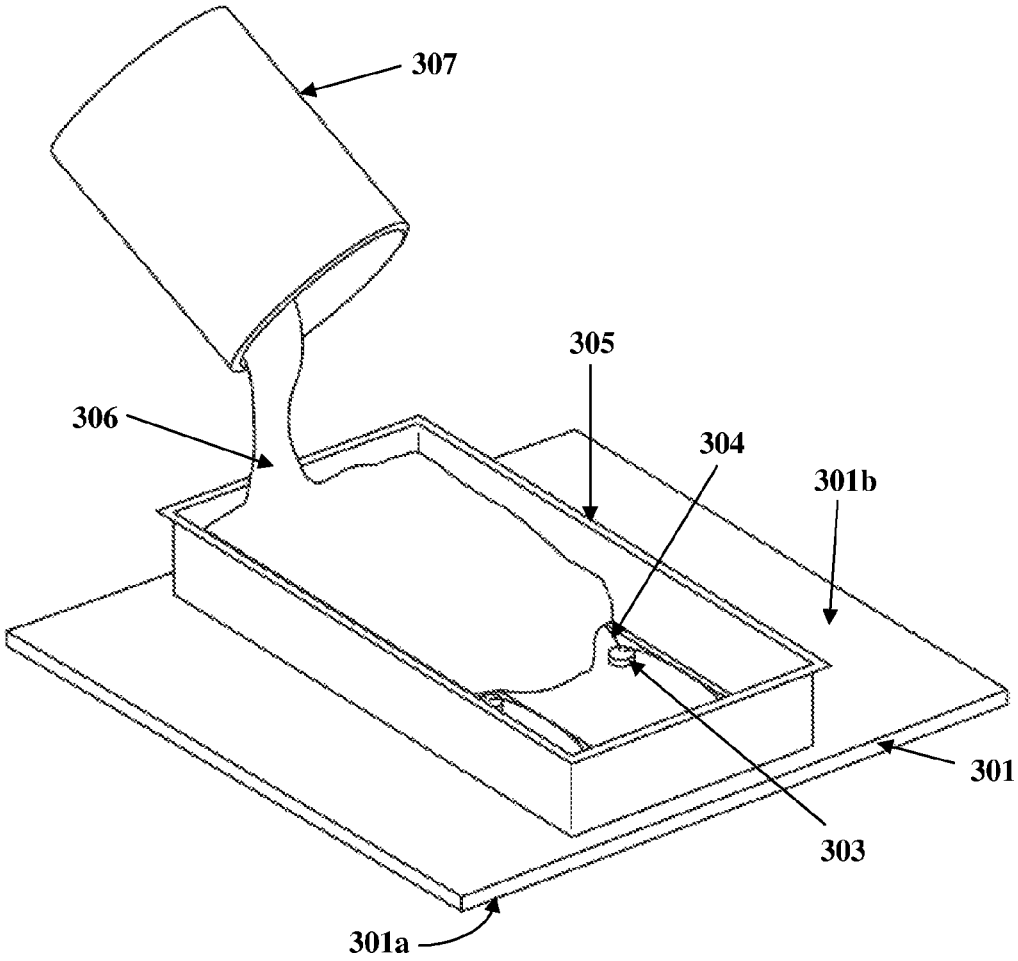
Figure 3D:
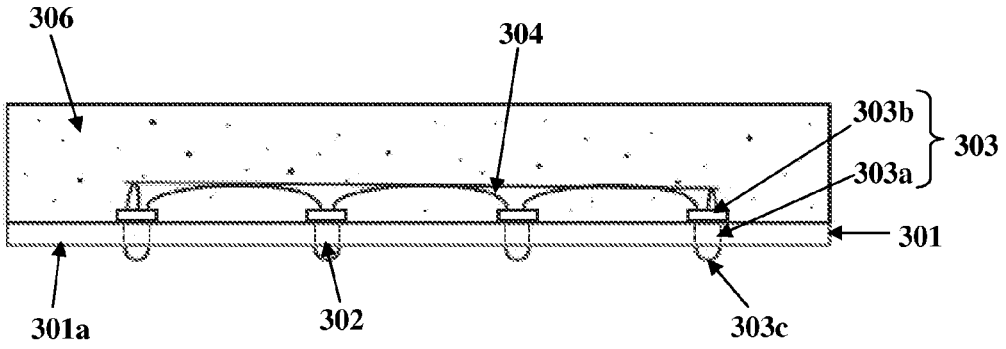
Figure 5:
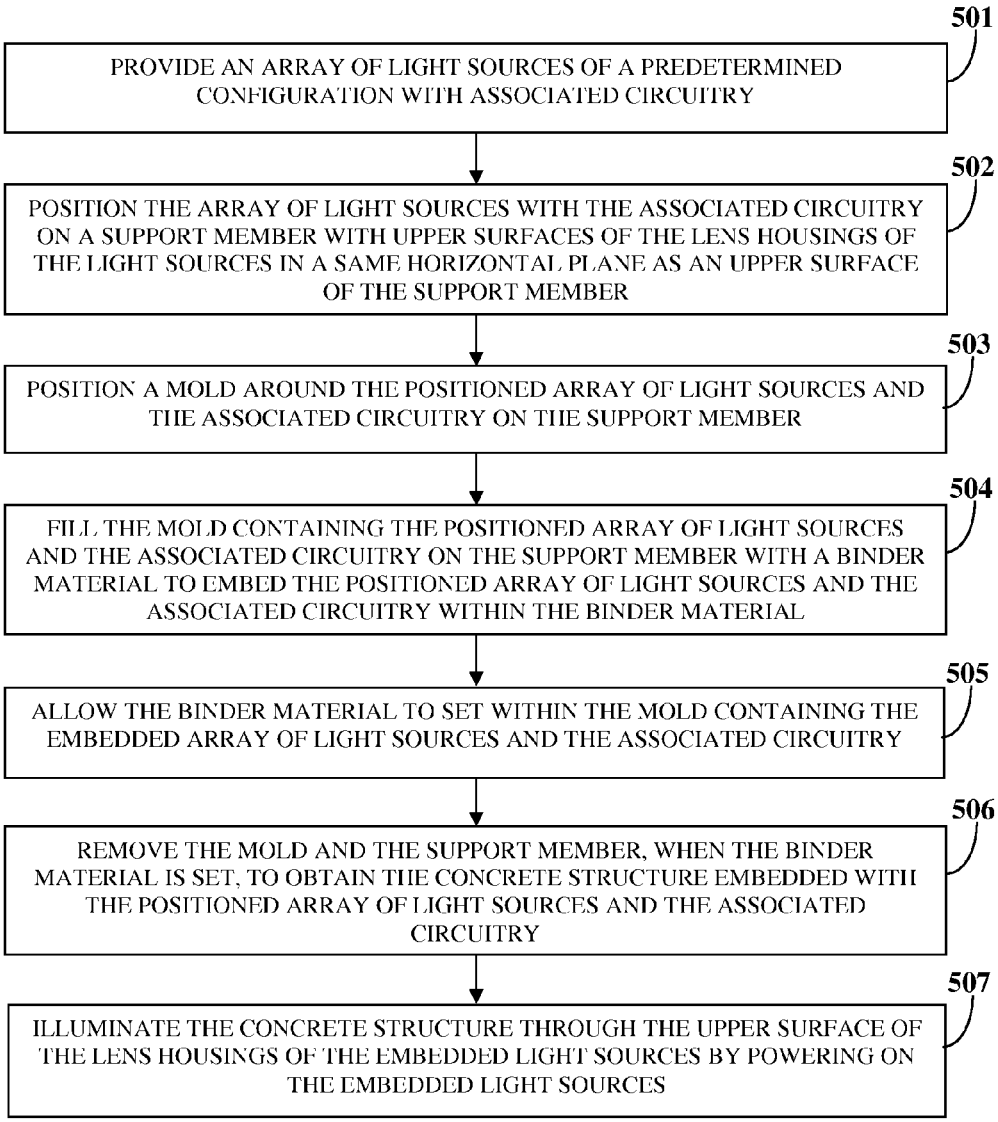
FIG. 5 illustrates an embodiment of the method for constructing a concrete structure with an array of light sources embedded in the concrete structure, where the light sources are recessed within the concrete structure with the upper surfaces of the lens housings of the embedded light sources in the same horizontal plane as the upper surface of the concrete structure.
Figure 6B:
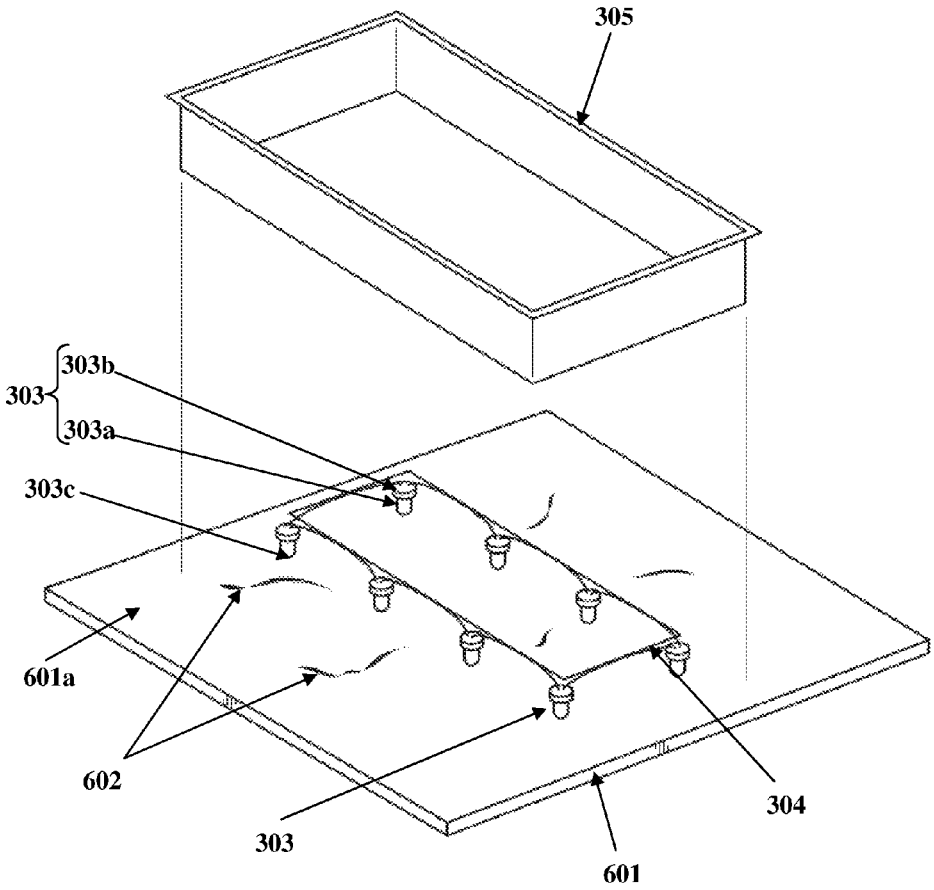
Figure 6C:
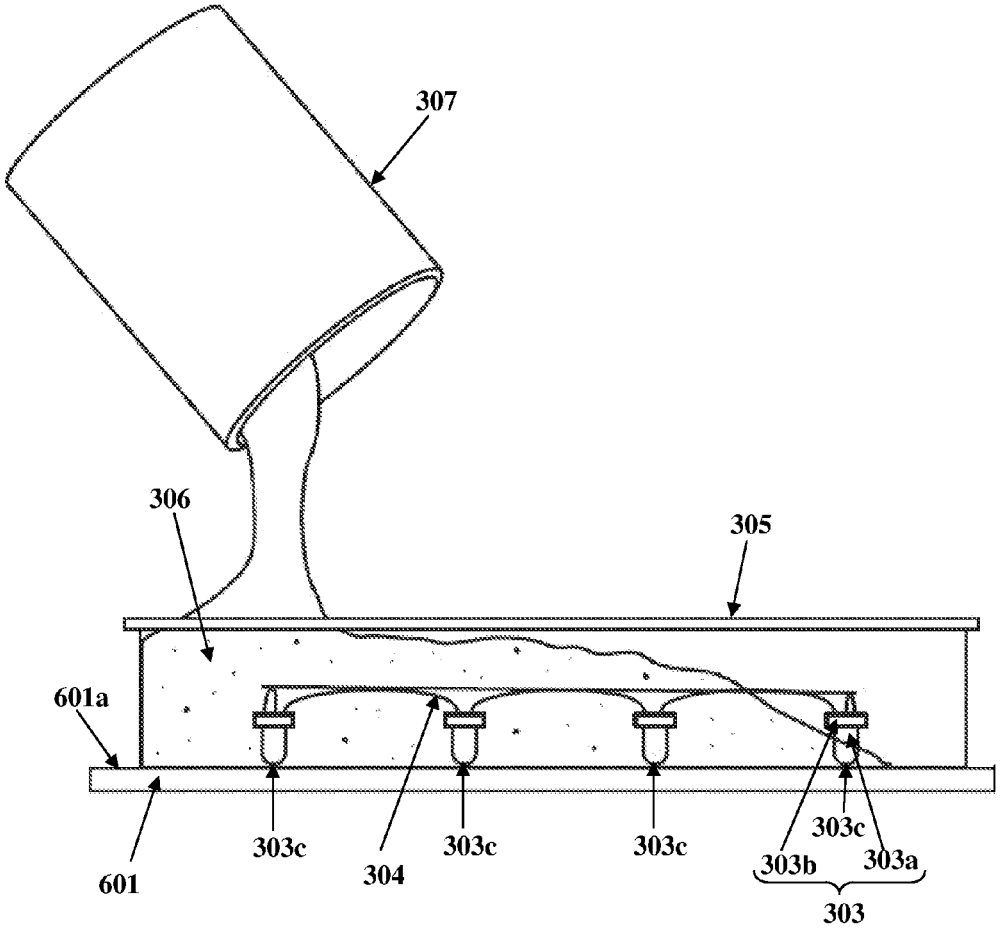
Figure 6D:
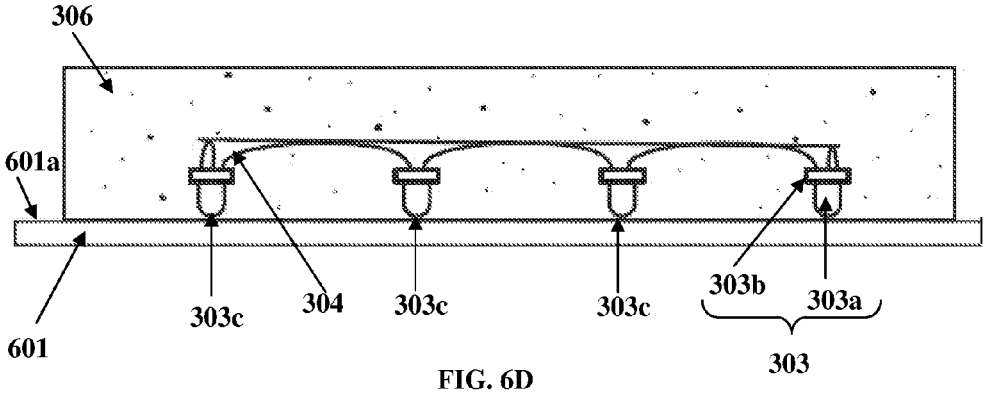

Also, as used herein, "support member" refers to a support structure configured, for example, as a support board or a support plate made of a non-adherent material, for example, a material that does not adhere to a binder material 306 exemplarily illustrated in FIG. 3C and FIG. 6C. The support member 301 or 601 is employed to position the light sources 303 before the binder material 306 is poured into a mold 305 or 701 exemplarily illustrated in FIG. 3B and FIG. 7A. The support member 301 or 601 is made of a transparent thermoplastic material, for example, Plexiglas® of Arkema France Corporation, polyvinyl chloride, plastic, resin, etc. Two methods for positioning the array of light sources 303 with the associated circuitry 304 on the support member 301 or 601 are disclosed in the detailed description of FIGS. 2-4C and FIGS. 5-7C. After the array of light sources 303 with the associated circuitry 304 is positioned on the support member 301 or 601, a mold 305 or 701 is positioned 102 around the positioned array of light sources 303 and the associated circuitry 304 on the support member 301 or 601. The mold 305 or 701 is configured in a geometrical shape, for example, a rectangle, a square, a heart shape, etc., of a predetermined size to contain the positioned array of light sources 303 and the associated circuitry 304 within the mold 305 or 701. The mold 305 or 701 is selected based on the size of the concrete structure 300 or 400 or 600 or 700 to be created for a particular application.

A binder material 306 exemplarily illustrated in FIG. 3C and FIG. 6C, is filled 103 in the mold 305 or 701 containing the positioned array of light sources 303 and the associated circuitry 304 on the support member 301 or 601 to embed the positioned array of light sources 303 and the associated circuitry 304 within the binder material 306. As used herein, "binder material" refers to a material or a substance in which the light sources 303 and the associated circuitry 304 are embedded and which sets to form the concrete structure 300 or 400 or 600 or 700. The binder material 306 comprises, for example, cement, a cement composite, silica sand, a silica composite, etc., or any combination thereof. In an embodiment, the binder material 306 is prepared by mixing a silica composite or silica sand, a cement composite, and Portland cement with a predefined amount of water. The lead electrical wire (not shown) that will be used to connect the associated circuitry 304 of the positioned array of light sources 303 to an external power supply unit (not shown) to power on the light sources 303, extends out of the mold 305 or 701 and is retained free of the binder material 306 while the binder material 306 is poured into the mold 305 or 701. The binder material 306 is allowed 104 to set within the mold 305 or 701 containing the embedded array of light sources 303 and the associated circuitry 304 to moisture seal the embedded array of light sources 303 and the associated circuitry 304.

When the binder material 306 is set, the mold 305 or 701 and the support member 301 or 601 are removed 105 from the set binder material 306 to obtain a concrete structure 300 or 400 or 600 or 700 embedded with the positioned array of light sources 303 and the associated circuitry 304 as exemplarily illustrated in FIGS. 3G-3H, FIGS. 4B-4C, FIGS. 6G-6H, and FIGS. 7B-7C. The embedded array of light sources 303 illuminates 106 the concrete structure 300 or 400 or 600 or 700 when the embedded array of light sources 300 is powered on. In an embodiment, a releasing agent is applied on the support member 301 or 601 prior to positioning the array of light sources 303 and the associated circuitry 304 to allow removal of the support member 301 or 601 from the constructed concrete structure 300 or 400 or 600 or 700. The associated circuitry 304 of the embedded array of light sources 303 is electrically connected to the external power supply unit (not shown) via the lead electrical wire (not shown) that extends out of the set binder material 306 of the concrete structure 300 or 400 or 600 or 700 to the external power supply unit. The concrete structure 300 or 400 or 600 or 700 can be constructed in any size, shape, and color for use in creation of a wide range of architectural elements and items. The constructed concrete structure 300 or 400 or 600 or 700 is used in multiple applications, for example, to create and illuminate vertical support columns in architectural applications, to create and illuminate counter tops, tabletops, building structures, driveways, walkways, sign boards, walls, floor tiles, bricks, etc. The constructed concrete structure 300 or 400 or 600 or 700 can also be used, for example, for decorative lighting in building structures, for airport guide lighting, etc.

Figure 4A:
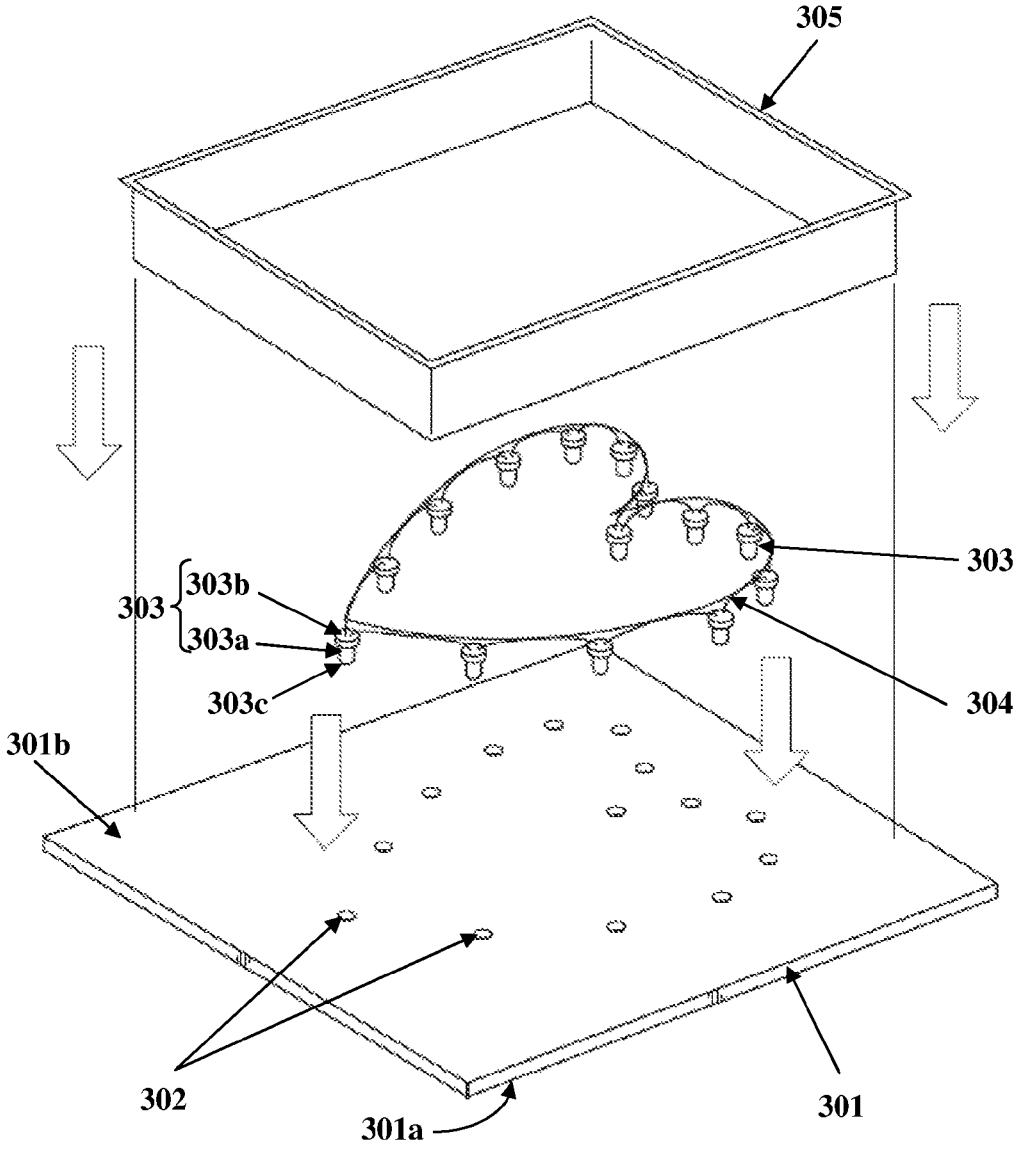
FIGS. 4A-4C exemplarily illustrate construction of a concrete structure with an array of light sources in a heart shaped configuration embedded in the concrete structure, where the lens housings of the embedded light sources protrude above the upper surface of the concrete structure.

FIG. 2 illustrates a method for constructing a concrete structure 300 or 400 with, an array of light sources 303 embedded in the concrete structure 300 or 400, where the lens housings 303*a* of the embedded light sources 303 protrude above an upper surface 300*a* or 400*a* of the concrete structure 300 or 400 as exemplarily illustrated in FIGS. 3G-3H and FIGS. 4B-4C. In the method disclosed herein, a support member 301 comprising perforations 302 in a predetermined configuration, for example, a rectangular configuration, a square configuration, a circular configuration, a heart shaped configuration, etc., and an array of light, sources 303 of the same predetermined configuration, for example, a rectangular configuration, a square configuration, a circular configuration, a heart shaped configuration, etc., with associated circuitry 304 as exemplarily illustrated in FIG. 3B and FIG. 4A, are provided 201. The predetermined configuration of the perforations 302 in the support member 301 is configured to mirror the predetermined configuration of the array of light sources 303 and the associated circuitry 304 to allow the lens housings 303*a* of the light sources 303 to fit through the perforations 302 of the support member 301 exactly. In this method, the array of light sources 303 with the associated circuitry 304 is positioned 202 on the support member 301 with the lens housings 303*a* of the light sources 303 inserted through the perforations 302 of the support member 301 and protruding below a lower surface 301*a* of the support member 301 as exemplarily illustrated in FIG. 3A. The lens housings 303*a* of the light sources 303 plug and seal the perforations 302 in the support member 301 so that the light sources 303 are contained on the support member 301 when a binder material 306 exemplarily illustrated in FIG. 3C, is applied thereon. A mold 305 exemplarily illustrated in FIG. 311 and FIG. 4A, is positioned 203 around the positioned array of light sources 303 and the associated circuitry 304 on the support member 301 to contain the positioned array of light sources 303 and the associated circuitry 304.

A binder material 306 is filled 204 into the mold 305 containing the positioned array of light sources 303 and the associated circuitry 304 on the support member 301 to embed the positioned array of light sources 303 and the associated circuitry 304 within the binder material 306 as exemplarily illustrated in FIG. 3C. The binder material 306 embeds the bases 303*b* of the light sources 303 and the associated circuitry 304 above an upper surface 301*b* of the support member 301, with the lens housings 303*a* of the light sources 303 protruding below the lower surface 301*a* of the support member 301, free of the binder material 306 as exemplarily illustrated in FIG. 3D. The binder material 306 is allowed 205 to set within the mold 305 containing the embedded array of light sources 303 and the associated circuitry 304. When the binder material 306 is set, the mold 305 and the support member 301 are removed 206 from the set binder material 306 to obtain the concrete structure 300 or 400 embedded with the positioned array of light sources 303 and the associated circuitry 304. The embedded light sources 303 are powered on to illuminate 207 the concrete structure 300 or 400 by the light emitted through the lens housings 303*a* of the embedded light sources 303 that protrude above an upper surface 300*a* or 400*a* of the concrete structure 300 or 400 as exemplarily illustrated in FIG. 3H and FIG. 4C.

FIGS. 3A-3H exemplarily illustrate construction of a concrete structure 300 with an array of light sources 303, for example, light emitting diodes (LEDs), in a predetermined configuration, for example, a rectangular configuration, embedded in the concrete structure 300, where the lens housings 303*a* of the embedded light sources 303 protrude above the upper surface 300*a* of the concrete structure 300. Consider an example where an array of light sources 303 and associated circuitry 304 of a rectangular configuration, a support member 301, for example, a Plexiglas® sheet comprising perforations 302 in a rectangular configuration to mirror the array of light sources 303, and a rectangular mold 305 are provided as exemplarily illustrated in FIG. 3B, for constructing a rectangular concrete structure 300. Each light source 303 comprises a base 303*b* and a lens housing 303*a* in communication with and distal from the base 303*b* as exemplarily illustrated in FIG. 3A. In this method, the array of light sources 303 with the associated circuitry 304 is positioned on the support member 301 with the lens housings 303*a* of the light sources 303 inserted through the perforations 302 of the support member 301 and protruding below the lower surface 301*a* of the support member 301 as exemplarily illustrated in FIG. 3A.

The rectangular mold 305 exemplarily illustrated in FIG. 3B, is positioned around the positioned array of light sources 303 and the associated circuitry 304 on the support member 301 to contain the positioned array of light sources 303 and the associated circuitry 304 as exemplarily illustrated in FIG. 3C. A binder material 306, for example, a white cement or a different colored cement is poured from a cement dispenser 307 and filled in the rectangular mold 305 containing the positioned array of light sources 303 and the associated circuitry 304 on the support member 301 as exemplarily illustrated in FIG. 3C, to embed the positioned array of light sources 303 and the associated circuitry 304 within the filled binder material 306.

Figure 3E:
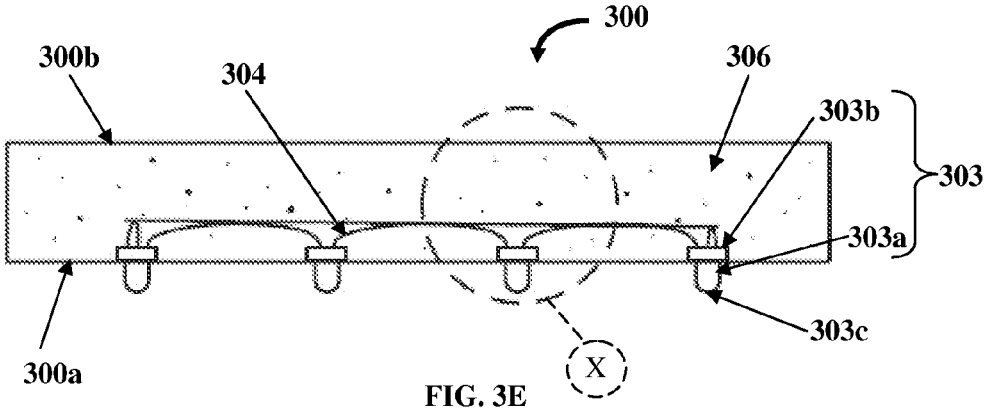
Figure 3F:
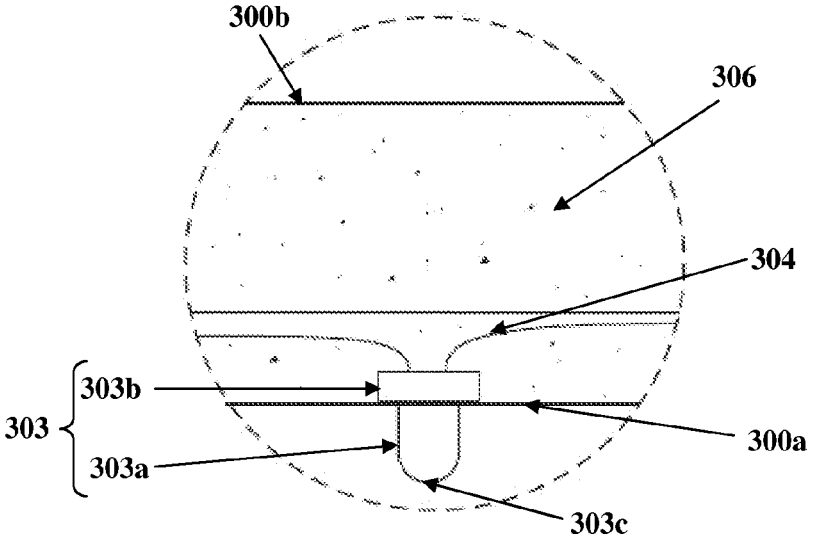
Figure 3G:
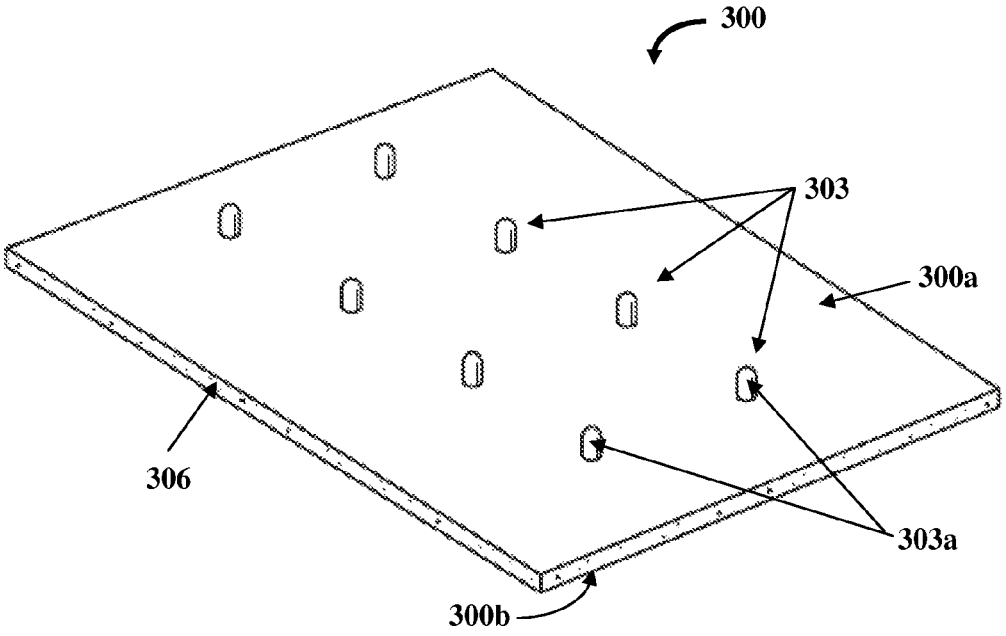
Figure 3H:
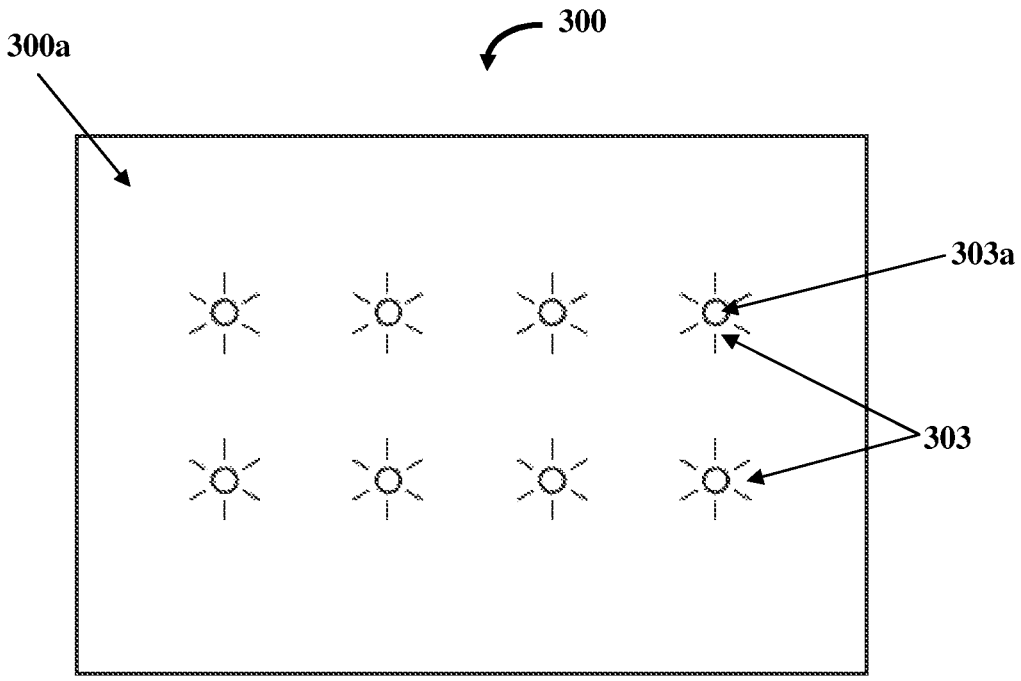

The filled binder material 306 is allowed to set. When the filled binder material 306 is set, the rectangular mold 305 is removed from the set binder material 306 with the positioned array of light sources 303 and the associated circuitry 304 as exemplarily illustrated in FIG. 3D, and then the support member 301 is removed from the set binder material 306 with the positioned array of light sources 303 and the associated circuitry 304 to obtain a rectangular concrete structure 300 embedded with the positioned array of light sources 303 and the associated circuitry 304, where the lens housings 303*a* of the embedded light sources 303 protrude above the upper surface 300*a* of the rectangular concrete structure 300 as exemplarily illustrated in FIGS. 3E-3G. The rectangular concrete structure 300 comprises an upper surface 300*a* and a lower surface 300*b* distal to the upper surface 300*a*. FIG. 3F exemplarily illustrates an enlarged view of a portion marked X in FIG. 3E, showing a lens housing 303*a* of an embedded light source 303 protruding above the upper surface 300*a* of the rectangular concrete structure 300. The rectangular concrete structure 300 is inverted or flipped to position the protruding lens housings 303*a* of the embedded light sources 303 in view of an observer as exemplarily illustrated in FIG. 3G, and the embedded light sources 303 is powered on, for example, using an external power supply unit (not shown) that supplies power to the embedded light sources 303 via the lead electrical wire (not shown), to allow the lens housings 303*a* of the embedded light sources 303 that protrude above the upper surface 300*a* of the rectangular concrete structure 300 to illuminate the rectangular concrete structure 300 in the rectangular configuration as exemplarily illustrated in FIG. 3H.

Figure 4B:
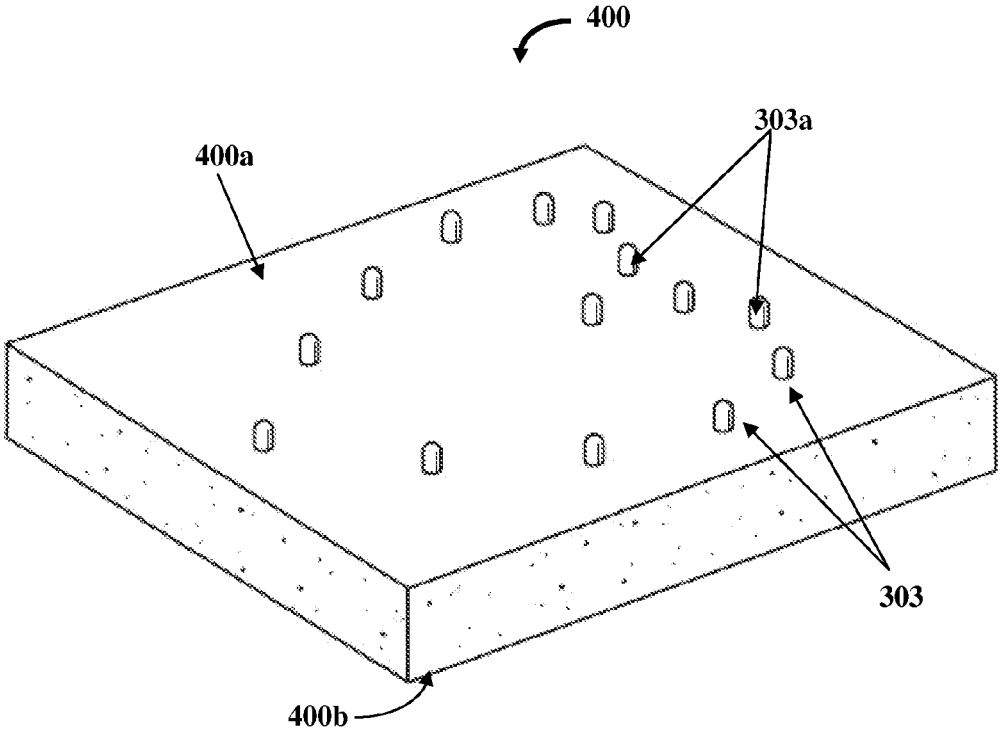
Figure 4C:
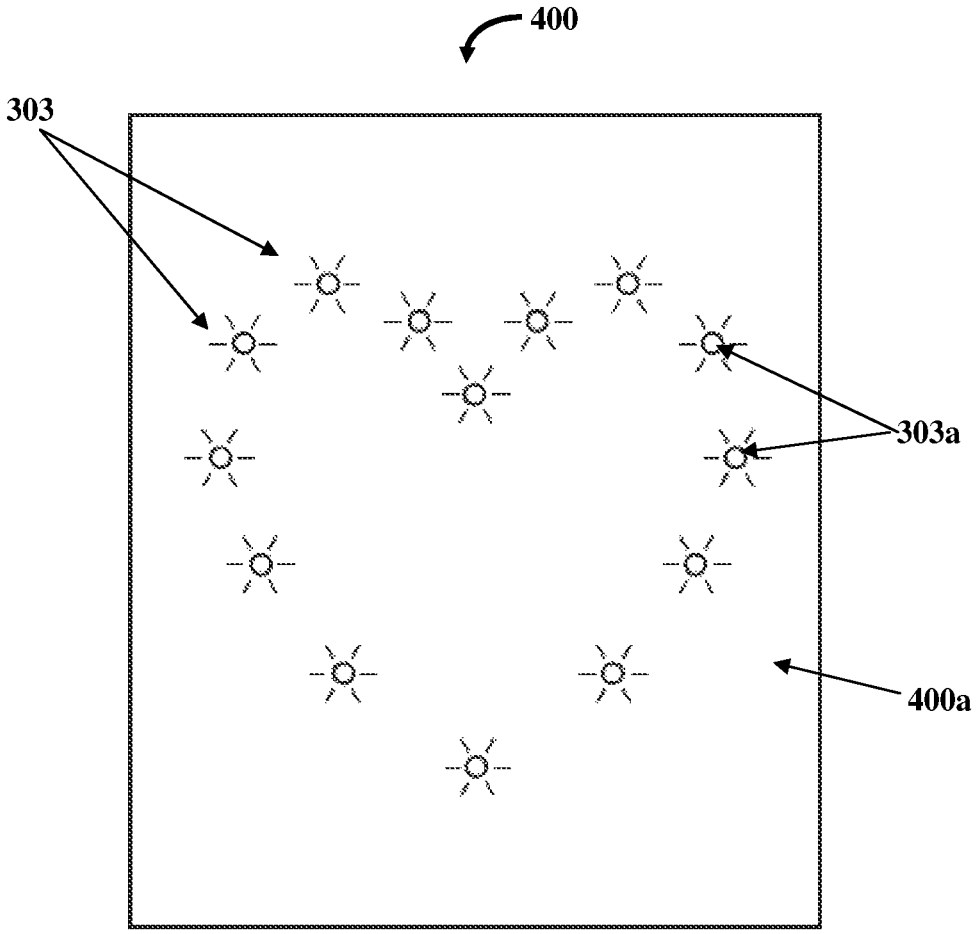

FIGS. 4A-4C exemplarily illustrate construction of a concrete structure 400 with an array of light sources 303 in a heart shaped configuration embedded in the concrete structure 400, where the lens housings 303*a* of the embedded light sources 303 protrude above the upper surface 400*a* of the concrete structure 400. For constructing the rectangular concrete structure 400 exemplarily illustrated in FIGS. 4B-4C, an array of light sources 303 and associated circuitry 304 of a heart shaped configuration, a support member 301, for example, a Plexiglas® sheet comprising perforations 302 in a heart shaped configuration to mirror the array of light sources 303, and a rectangular mold 305 are provided. The array of light sources 303 with the associated circuitry 304 is positioned on the support member 301 as exemplarily illustrated in FIG. 4A. The rectangular mold 305 exemplarily illustrated in FIG. 4A, is positioned around the positioned array of light sources 303 and the associated circuitry 304 on the support member 301 to contain the positioned array of light sources 303 and the associated circuitry 304. A binder material 306, for example, a mixture of a silica composite or silica sand, a cement composite, Portland cement, and a predefined amount of water is filled in the rectangular mold 305 containing the positioned array of light sources 303 and the associated circuitry 304 on the support member 301 using a cement dispenser 307 as exemplarily illustrated in FIG. 3C. The binder material 306 is allowed to set and then the rectangular mold 305 and the support member 301 are removed to obtain the rectangular concrete structure 400 embedded with the positioned array of light sources 303 and the associated circuitry 304, where the lens housings 303*a* of the embedded light sources 303 protrude above the upper surface 400*a* of the rectangular concrete structure 400 as exemplarily illustrates in FIG. 4B. The rectangular concrete structure 400 comprises a lower surface 400*b* distal to the upper surface 400*a* of the rectangular concrete structure 400. The protruding lens housings 303*a* of the embedded light sources 303 provide illumination as exemplarily illustrated in FIG. 4C, when the embedded light sources 303 are powered on. The rectangular concrete structure 400 is inverted or flipped to position the protruding lens housings 303*a* of the embedded light sources 303 in view of an observer as exemplarily illustrates in FIG. 4B, and the embedded light sources 303 are powered on, for example, using an external power supply unit (not shown) that supplies power to the embedded light sources 303 via the lead electrical wire (not shown), to allow the protruding lens housings 303*a* of the embedded light sources 303 to illuminate the rectangular concrete structure 400 in the heart shaped configuration as exemplarily illustrated in FIG. 4C.

FIG. 5 illustrates an embodiment of the method for constructing a concrete structure 600 or 700 with an array of light sources 303 embedded in the concrete structure 600 or 700, where the light sources 303 are recessed within the concrete structure 600 or 700 with the upper surfaces 303*c* of the lens housings 303*a* of the embedded light sources 303 in the same horizontal plane as the upper surface 600*a* or 700*a* of the concrete structure 600 or 700 as exemplarily illustrated in FIGS. 6G-6H, and FIGS. 7B-7C. An array of light sources 303 of a predetermined configuration, for example, a rectangular configuration, a square configuration, a circular configuration, a heart shaped configuration, etc., with associated circuitry 304 as exemplarily illustrated in FIGS. 6A-6H, and FIGS. 7A-7C, is provided 501. Each light source 303 comprises a base 303*b* and a lens housing 303*a* in communication with and distal from the base 303*b* as exemplarily illustrated in FIG. 6A. The lens housing 303*a* of each light source 303 comprises an upper surface 303*c* as exemplarily illustrated in FIG. 6A. In this embodiment, the support member 601 does not have perforations. In this embodiment, the array of light sources 303 with the associated circuitry 304 is positioned 502 on the support member 601 with upper surfaces 303*c* of the lens housings 303*a* of the light sources 303 in the same horizontal plane as an upper surface 601*a* of the support member 601 as exemplarily illustrated in FIGS. 6A-6B. A mold 305 or 701 exemplarily illustrated in FIG. 6B and FIG. 7A, is positioned 503 around the positioned array of light sources 303 and the associated circuitry 304 on the support member 601. A binder material 306 is filled 504 in the mold 305 or 701 containing the positioned array of light sources 303 and the associated circuitry 304 on the support member 601 as exemplarily illustrated in FIG. 6C, to embed the positioned array of light sources 303 and the associated circuitry 304 within the binder material 306. The binder material 306 completely embeds the positioned array of light sources 303 and the associated circuitry 304 above the upper surface 601*a* of the support member 601 as exemplarily illustrated in FIG. 6D. The binder material 306 is allowed 505 to set within the mold 305 or 701 containing the embedded array of light sources 303 and the associated circuitry 304. When the binder material 306 is set, the mold 305 or 701 and the support member 601 are removed 506 from the set binding material 306 to obtain the concrete structure 600 or 700 embedded with the positioned array of light sources 303 and the associated circuitry 304. When the mold 305 or 701 and the support member 601 are removed, the upper surfaces 303*c* of the lens housings 303*a* of the embedded light sources 303 are in the same horizontal plane as the upper surface 600*a* or 700*a* of the concrete structure 600 or 700. The embedded light sources 303 illuminate 507 the concrete structure 600 or 700 through the upper surfaces 303*c* of the lens housings 303*a* of the embedded light sources 303 when the embedded light sources 303 are powered on.

FIGS. 6A-6H exemplarily illustrate construction of a concrete structure 600 with an array of light sources 303, for example, light emitting diodes (LEDs), in a predetermined configuration, for example, in a rectangular configuration embedded in the concrete structure 600, where the light sources 303 are recessed within the concrete structure 600 with the upper surfaces 303*c* of the lens housings 303*a* of the embedded light sources 303 in the same horizontal plane as the upper surface 600*a* of the concrete structure 600. Consider an example where an array of light sources 303 and associated circuitry 304 of a rectangular configuration, a support member 601, for example, a Plexiglas® sheet, and a rectangular mold 305 are provided as exemplarily illustrated in FIG. 6B, for constructing a rectangular concrete structure 600. Each light source 303 comprises a base 303*b* and a lens housing 303*a* in communication with and distal from the base 303*b* as exemplarily illustrated in FIG. 6A. The lens housing 303*a* of each light source 303 comprises an upper surface 303*c* as exemplarily illustrated in FIG. 6A. In this embodiment, the array of light sources 303 with the associated circuitry 304 is positioned on the support member 601 with the upper surfaces 303*c* of the lens housings 303*a* of the light sources 303 in the same horizontal plane as the upper surface 601*a* of the support member 601 as exemplarily illustrated in FIGS. 6A-6B.

In an embodiment, a decorative pattern 602 is created, for example, by marbling, on the support member 601, prior to the positioning of the array of light sources 303 and the associated circuitry 304 on the support member 601 and the filling of the rectangular mold 305 with the binder material 306 on the support member 601, to obtain a decorative upper layer in the rectangular concrete structure 600. The decorative pattern 602 is, for example, a marbled pattern, a veined pattern, etc., exemplarily illustrated in FIG. 6B, created using decorative elements. The decorative elements comprise, for example, fine silica glass materials, coarse silica glass materials, ground colored glass, etc., and any combination thereof.

In an embodiment, the decorative pattern 602 is created, for example, by mixing fine and/or coarse colored glass particles, cement such as Portland cement, and water to create a slurry, placing the slurry in small amounts in a random manner or another manner on the upper surface 601*a* of the support member 601, and allowing the slurry to set. The positioning of the fine and/or coarse colored glass particles in the set slurry creates the decorative pattern 602. FIGS. 6G-6H exemplarily illustrate the decorative upper layer containing the decorative pattern 602 created in the rectangular concrete structure 600 on the upper surface 600*a* of the rectangular concrete structure 600. In another embodiment, after randomly placing the slurry in small amounts on the upper surface 601*a* of the support member 601, a brush or a writing element can be used to create, for example, designs, alphabets, lettering, complete words, numbers, shapes, faces, silhouettes, objects, etc., on the slurry on the upper surface 601*a* of the support member 601 before allowing the slurry to set. In another embodiment, designs, alphabets, lettering, complete words, numbers, shapes, faces, silhouettes, objects, etc., can be manually created on the slurry on the upper surface 601*a* of the support member 601 before allowing the slurry to set. In another embodiment, cement mixed with decorative elements, for example, ground glass is used to create random decorative patterns 602 on the upper surface 601*a* of the support member 601 prior to pouring the binder material 306 in the rectangular mold 305 containing the positioned array of light sources 303 and the associated circuitry 304 on the support member 601. In this embodiment, the cement mixed with the decorative elements is veined as the binder material 306 is poured to create the decorative patterns 602 on the upper surface 600*a* of the rectangular concrete structure 600 as exemplarily illustrated in FIGS. 6H-61. As disclosed in the above embodiments, a decorative pattern 602 exemplarily illustrated in FIG. 6B, can also be created on the upper surface 301*b* of the support member 301 exemplarily illustrated in FIG. 3B and FIG. 4A, using decorative elements, prior to the positioning of the array of light sources 303 and the associated circuitry 304 on the support member 301 and the filling of the rectangular mold 305 with the binder material 306 on the support member 301, to obtain a decorative upper layer in the rectangular concrete structure 300 or 400 exemplarily illustrated in FIG. 3H and FIG. 4C.

After the decorative pattern 602 is created on the upper surface 601*a* of the support member 601, the rectangular mold 305 exemplarily illustrated in FIG. 6B, is positioned around the positioned array of light sources 303 and the associated circuitry 304 on the support member 601 to contain the positioned array of light sources 303 and the associated circuitry 304. A binder material 306, for example, a cement is poured from a cement dispenser 307 and filled in the rectangular mold 305 containing the positioned array of light sources 303 and the associated circuitry 304 on the support member 601 as exemplarily illustrated in FIG. 6C, to embed the positioned array of light sources 303 and the associated circuitry 304 within the filled binder material 306. The filled binder material 306 is allowed to set. When the filled binder material 306 is set, the rectangular mold 305 is removed from the set binder material 306 with the positioned array of light sources 303 and the associated circuitry 304 as exemplarily illustrated in FIG. 6D, and then the support member 601 is removed from the set binder material 306 with the positioned array of light sources 303 and the associated circuitry 304 to obtain a rectangular concrete structure 600 embedded with the positioned array of light sources 303 and the associated circuitry 304 as exemplarily illustrated in FIG. 6E. The rectangular concrete structure 600 comprises an upper surface 600*a* and a lower surface 600*b* distal to the upper surface 600*a*.

Figure 6E:
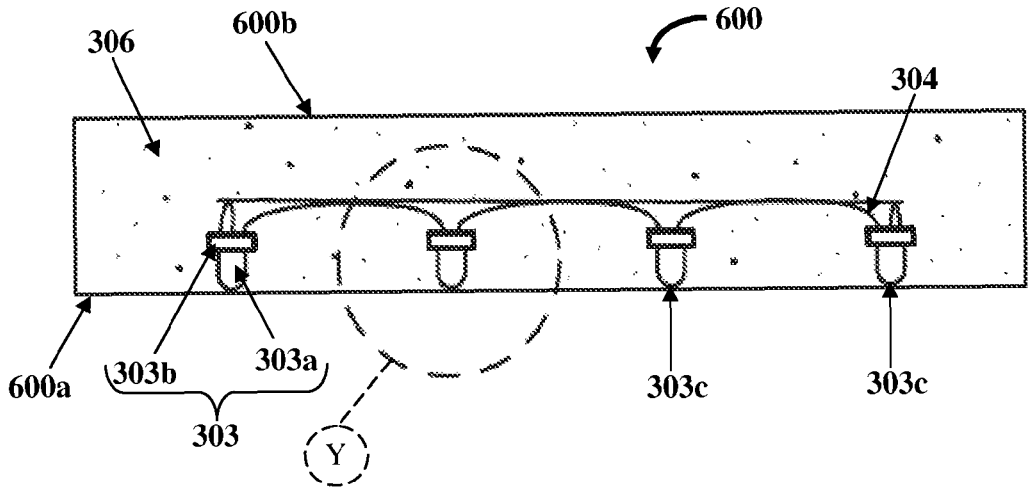
Figure 6F:
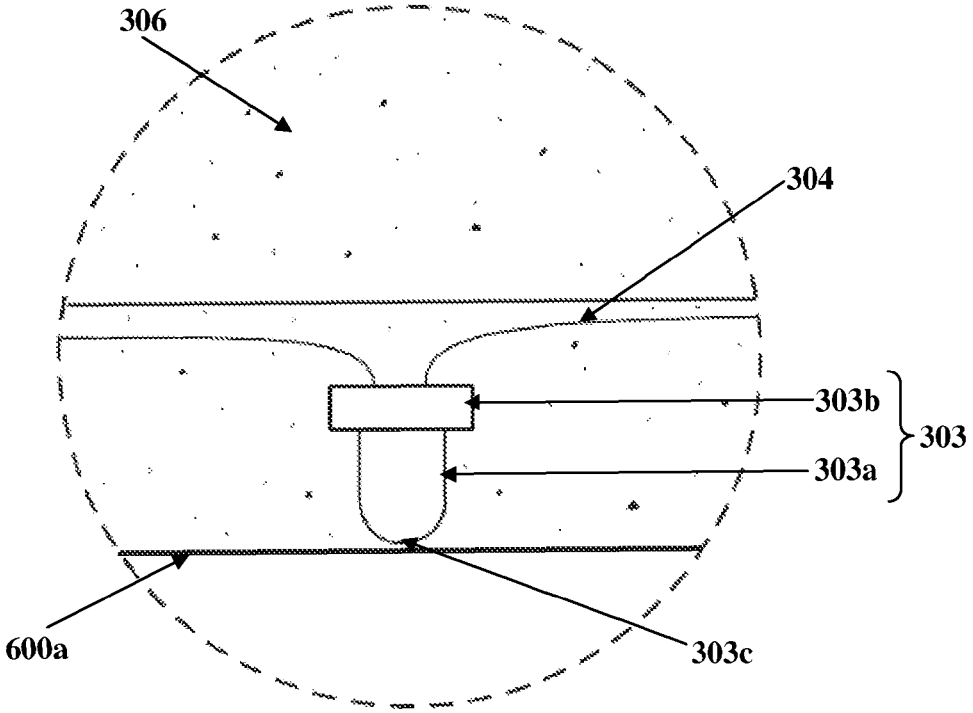
Figure 6G:
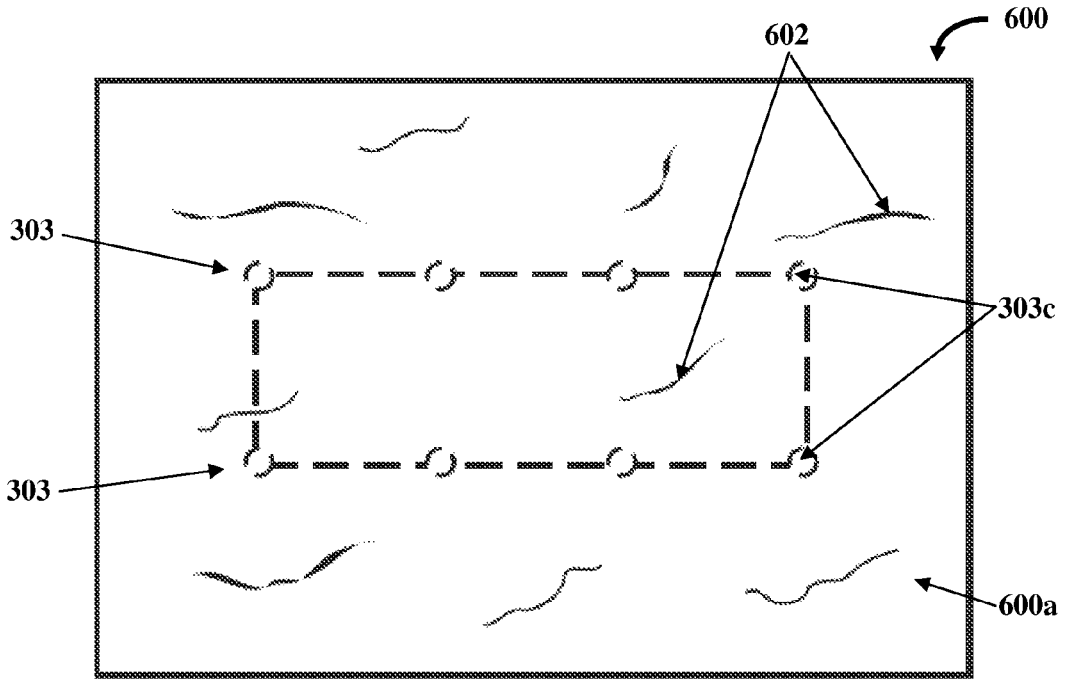
Figure 6H:
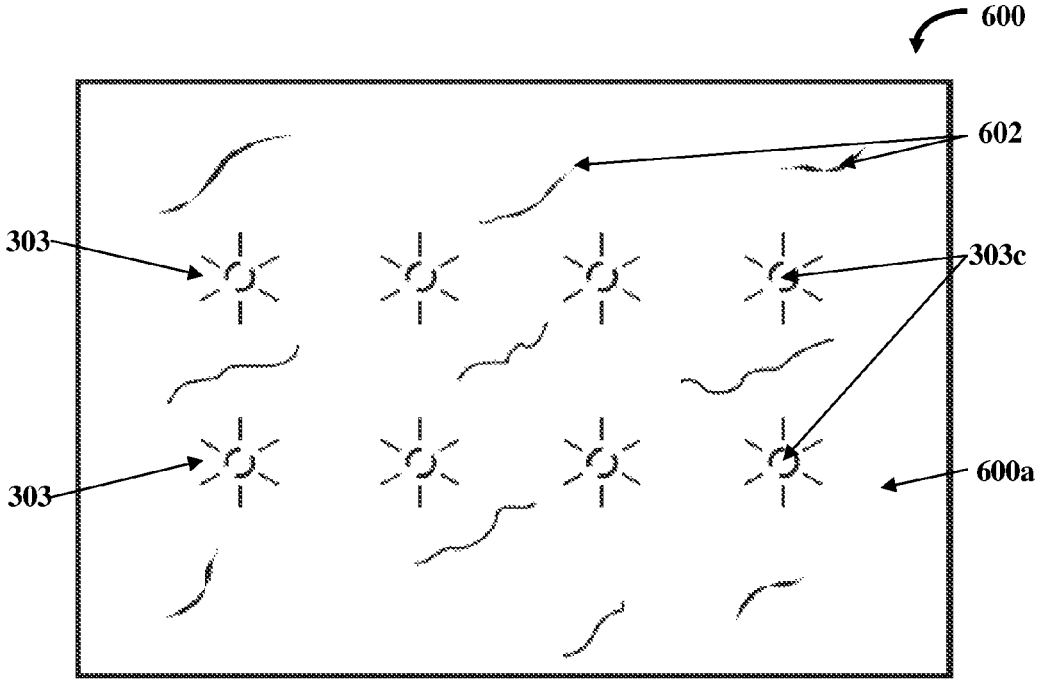
Figure 7A:
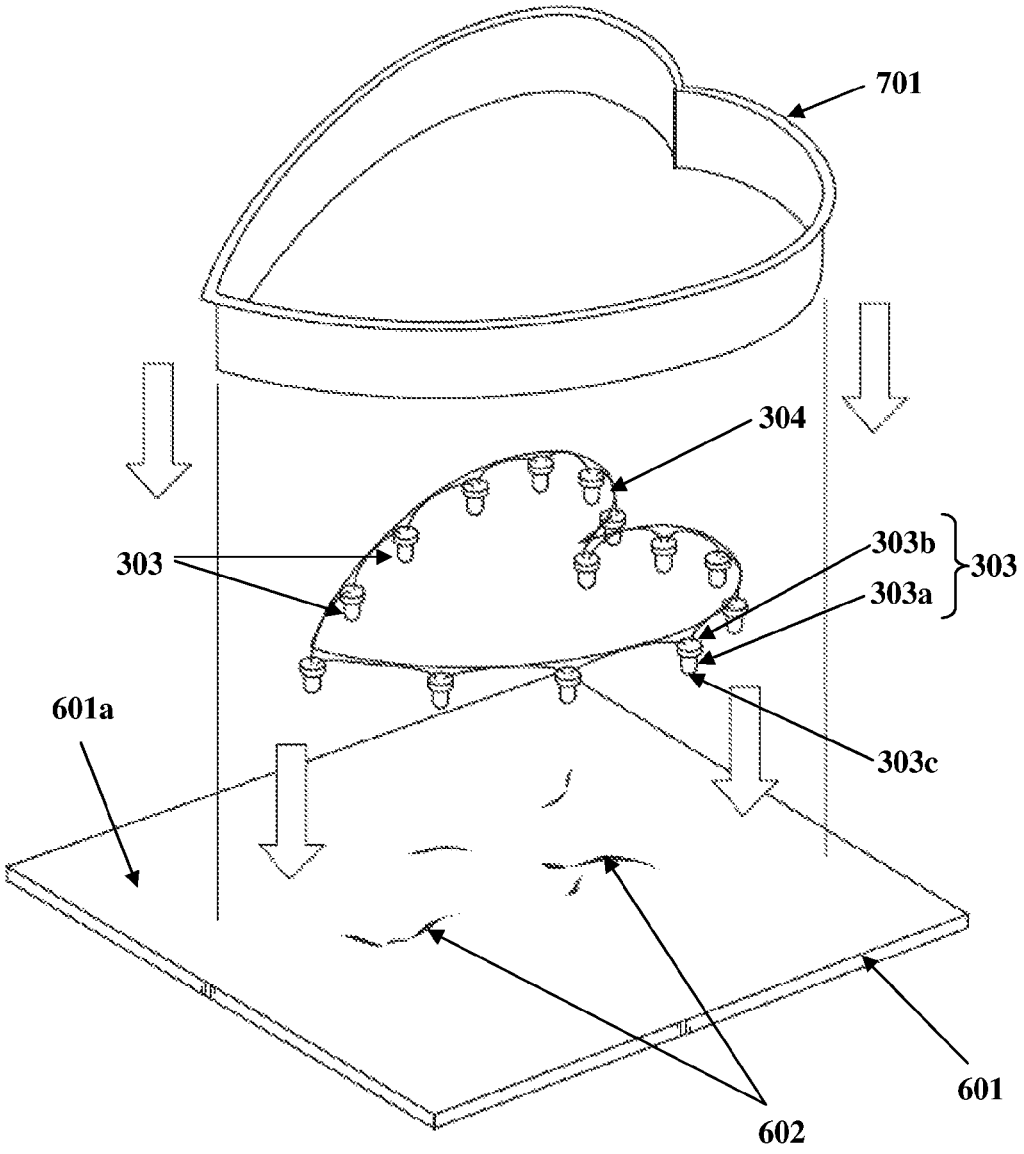
FIGS. 7A-7C exemplarily illustrate construction of a concrete structure with an array of light sources in a heart shaped configuration embedded in the concrete structure, where the light sources are recessed within the concrete structure with the upper surfaces of the lens housings of the embedded light sources in the same horizontal plane as the upper surface of the concrete structure.

When the rectangular mold 305 and the support member 601 are removed, the upper surfaces 303*c* of the lens housings 303*a* of the embedded light sources 303 are in the same horizontal plane as the upper surface 600*a* of the rectangular concrete structure 600 as exemplarily illustrated in FIGS. 6E-6F. FIG. 6F exemplarily illustrates an enlarged view of a portion marked Y in FIG. 6E, showing a recessed upper surface 303*c* of an embedded light source 303 positioned, for example, about one or two millimeters above the upper surface 600*a* of the rectangular concrete structure 600. The rectangular concrete structure 600 is inverted or flipped to position the upper surfaces 303*c* of the lens housings 303*a* of the embedded light sources 303 in view of an observer as exemplarily illustrated in FIG. 6G, and the embedded light sources 303 are powered on, for example, using an external power supply unit (not shown) that supplies power to the embedded light sources 303 via the lead electrical wire (not shown), to allow the upper surfaces 303*c* of the lens housings 303*a* of the embedded light sources 303 to illuminate the rectangular concrete structure 600 in the rectangular configuration as exemplarily illustrated in FIG. 6H.

Figure 7B:
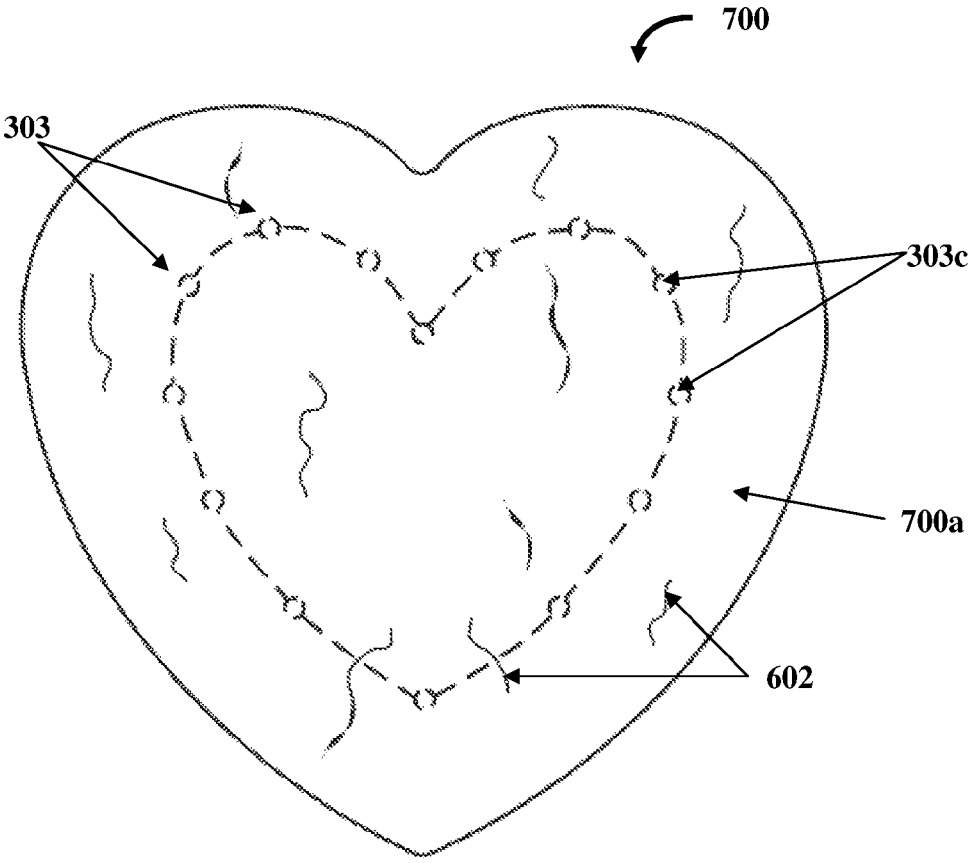
Figure 7C:
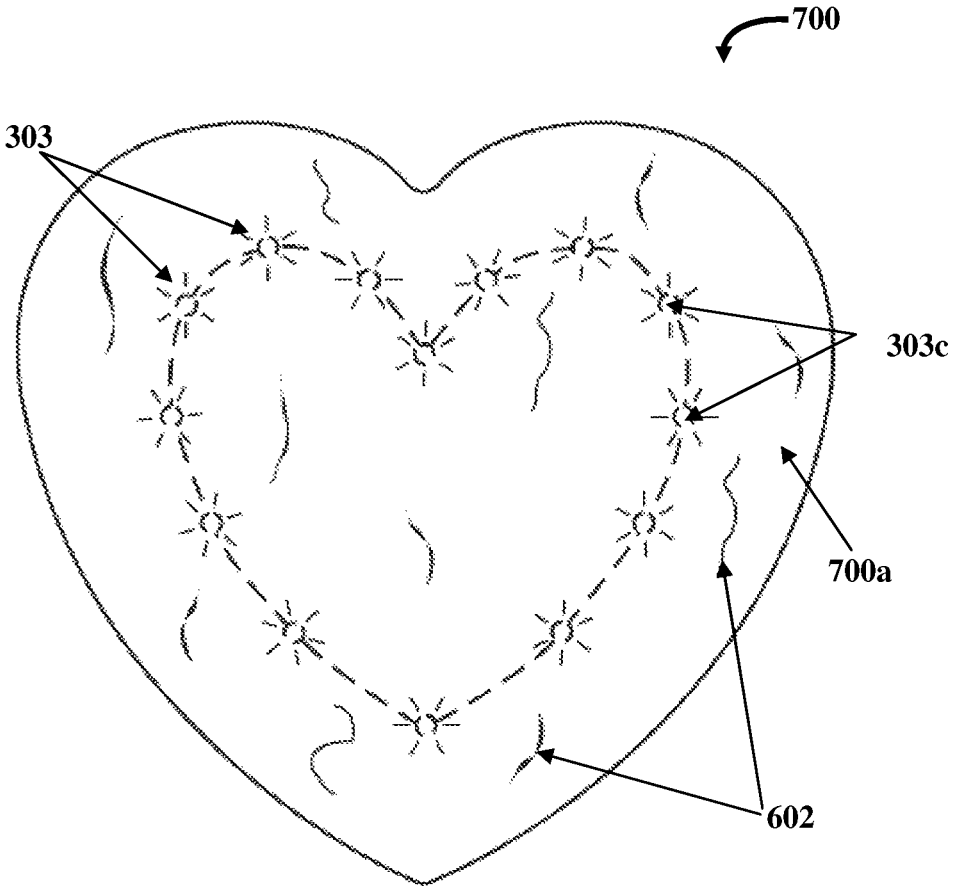

FIGS. 7A-7C exemplarily illustrate construction of a concrete structure 700 with an array of light sources 303 in a heart shaped configuration embedded in the concrete structure 700, where the light sources 303 are recessed within the concrete structure 700 with the upper surfaces 303*c* of the lens housings 303*a* of the embedded light sources 303 in the same horizontal plane as the upper surface 700*a* of the concrete structure 700. Consider an example where an array of light sources 303 and associated circuitry 304 of a heart shaped configuration, a support member 601, for example, a Plexiglas® sheet, and a heart shaped mold 701 as exemplarily illustrated in FIG. 7A, are provided for constructing a heart shaped concrete structure 700 exemplarily illustrated in FIGS. 7B-7C. The array of light sources 303 is positioned on the support member 601 such that the upper surfaces 303*c* of the lens housings 303*a* of the light sources 303 are in the same horizontal plane as the upper surface 601*a* of the support member 601 as exemplarily illustrated in FIG. 6A. A decorative pattern 602 is created on the upper surface 601*a* of the support member 601 prior to the positioning of the array of light sources 303 and the associated circuitry 304 on the support member 601 and the filling of the heart shaped mold 701 with a binder material 306 on the support member 601, to obtain a decorative upper layer in the heart shaped concrete structure 700 as exemplarily illustrated in FIGS. 7B-7C.

The heart shaped mold 701 exemplarily illustrated in FIG. 7A, is positioned around the positioned array of light sources 303 and the associated circuitry 304 on the support member 601 to contain the positioned array of light sources 303 and the associated circuitry 304. A binder material 306 comprising, for example, a mixture of silica sand, a cement composite, Portland cement, and a predefined amount of water is filled in the heart shaped mold 701 containing the positioned array of light sources 303 and the associated circuitry 304 on the support member 601 using a cement dispenser 307 exemplarily illustrated in FIG. 6C. The binder material 306 is allowed to set and then the heart shaped mold 701 and the support member 601 are removed to obtain a heart shaped concrete structure 700 embedded with the positioned array of light sources 303 and the associated circuitry 304. When the heart shaped mold 701 and the support member 601 are removed, the upper surfaces 303*c* of the lens housings 303*a* of the embedded light sources 303 are in the same horizontal plane as the upper surface 700*a* of the heart shaped concrete structure 700 as exemplarily illustrated in FIG. 7B. The embedded light sources 303 illuminate the heart shaped concrete structure 700 through the upper surfaces 303*c* of the lens housings 303*a* of the embedded light sources 303 in the heart shaped configuration as exemplarily illustrated in FIG. 7C, when the embedded light sources 303 are powered on, for example, using an external power supply unit (not shown) that supplies power to the embedded light sources 303 via the lead electrical wire (not shown).

The foregoing examples have been provided merely for the purpose of explanation and are in no way to be construed as limiting of the method disclosed herein. While the method has been described with reference to various embodiments, it is understood that the words, which have been used herein, are words of description and illustration, rather than words of limitation. Further, although the method has been described herein with reference to particular means, materials, and embodiments, the method is not intended to be limited to the particulars disclosed herein; rather, the method extends to all functionally equivalent structures, methods and uses, such as are within the scope of the appended claims. Those skilled in the art, having the benefit of the teachings of this specification, may effect numerous modifications thereto and changes may be made without departing from the scope and spirit of the method disclosed herein in its aspects.

I claim:

1. A method for constructing a concrete structure illuminated by light sources embedded in said concrete structure, said method comprising:

positioning an array of light sources of a predetermined configuration with associated circuitry on a support member, each of said light sources comprising a base and a lens housing in communication with and distal from said base, wherein said array of light sources is positioned on said support member with said lens housing of said each of said light sources inserted through perforations configured in said predetermined configuration in said support member and protruding below a lower surface of said support member;

positioning a mold around said positioned array of light sources and said associated circuitry on said support member;

filling said mold containing said positioned array of light sources and said associated circuitry on said support member with a binder material to embed said positioned array of light sources and said associated circuitry within said binder material;

allowing said binder material to set within said mold containing said embedded array of light sources and said associated circuitry; and removing said mold and said support member, when said binder material is set, to obtain said concrete structure embedded with said positioned array of light sources and said associated circuitry, wherein said embedded array of light sources illuminates said concrete structure when said embedded array of light sources is powered on.

2. The method of claim 1, wherein said hinder material comprises one or more of cement, a cement composite, silica sand, and a silica composite.

3. The method of claim 1, wherein said support member is made of a non-adherent material.

4. A method for constructing a concrete structure illuminated by light sources embedded in said concrete structure, said method comprising:

providing a support member comprising perforations in a predetermined configuration and an array of light sources of said predetermined configuration with associated circuitry, each of said light sources comprising a base and a lens housing in communication with and distal from said base;

positioning said array of light sources with said associated circuitry on said support member with said lens housing of said each of said light sources inserted through said perforations of said support member and protruding below a lower surface of said support member;

positioning a mold around said positioned array of light sources and said associated circuitry on said support member;

filling said mold containing said positioned array of light sources and said associated circuitry on said support member with a binder material to embed said positioned array of light sources and said associated circuitry within said binder material, wherein said binder material embeds said base of said each of said light sources and said associated circuitry above an upper surface of said support member, and wherein said lens housing of said each of said light sources protrudes below said lower surface of said support member free of said binder material;

allowing said binder material to set within said mold containing said embedded array of light sources and said associated circuitry; and removing said mold and said support member, when said binder material is set, to obtain said concrete structure embedded with said positioned array of light sources and said associated circuitry, wherein said embedded array of light sources illuminates said concrete structure through said lens housing of each of said embedded array of light sources that protrudes above an upper surface of said concrete structure when said embedded array of light sources is powered on.

5. The method of claim 4, further comprising creating a decorative pattern on said support member prior to said positioning of said array of light sources and said associated circuitry on said support member and said filling of said mold with said binder material on said support member to obtain a decorative upper layer in said concrete structure.

6. The method of claim 5, wherein said decorative pattern is one of a marbled pattern and a veined pattern created using decorative elements.

7. The method of claim 6, wherein said decorative elements comprise fine glass materials, coarse glass materials, ground colored glass materials, and any combination thereof.

8. The method of claim 4, wherein said binder material comprises one or more of cement, a cement composite, silica sand, and a silica composite.

9. The method of claim 4, wherein said support member is made of a non-adherent material.

10. A method for constructing a concrete structure illuminated by light sources embedded in said concrete structure, said method comprising:

providing an array of light sources of a predetermined configuration with associated circuitry, each of said light sources comprising a base and a lens housing in communication with and distal from said base;

positioning said array of light sources with said associated circuitry on a support member with an upper surface of said lens housing of said each of said light sources in a same horizontal plane as an upper surface of said support member;

positioning a mold around said positioned array of light sources and said associated circuitry on said support member;

filling said mold containing said positioned array of light sources and said associated circuitry on said support member with a binder material to embed said positioned array of light sources and said associated circuitry within said binder material, wherein said binder material completely embeds said positioned array of light sources and said associated circuitry above said upper surface of said support member;

allowing said binder material to set within said mold containing said embedded array of light sources and said associated circuitry, and removing said mold and said support member, when said hinder material is set, to obtain said concrete structure embedded with said positioned array of fight sources and said associated circuitry, wherein said upper surface of said lens housing of each of said embedded array of light sources is in a same horizontal plane as an upper surface of said concrete structure, and wherein said embedded array of light sources illuminates said concrete structure through said upper surface of said lens housing of said each of said embedded array of light sources when said embedded array light sources is powered on.

11. The method of claim 10, further comprising creating a decorative pattern on said support member prior to said positioning of said array of light sources and said associated circuitry on said support member and said filling of said mold with said binder material on said support member to obtain a decorative upper layer in said concrete structure.

12. The method of claim 11, wherein said decorative pattern is one of a marbled pattern and a veined pattern created using decorative elements.

13. The method of claim 12, wherein said decorative elements comprise fine glass materials, coarse glass materials, ground colored glass materials, and any combination thereof.

14. The method of claim 10, wherein said binder material comprises one or more of cement, a cement composite, silica sand, and a silica composite.

15. The method of claim 10, wherein said support member is made of a non-adherent material.

16. A method for constructing a concrete structure illuminated by light sources embedded in said concrete structure, said method comprising:

positioning an array of light sources of a predetermined configuration with associated circuitry on a support member, each of said light sources comprising a base and a lens housing in communication with and distal from said base, wherein said array of light sources is positioned on said support member with an upper surface of said lens housing of said each of said light sources in a same horizontal plane as an upper surface of said support member;

positioning a mold around said positioned array of light sources and said associated circuitry on said support member;

filling said mold containing said positioned array of light sources and said associated circuitry on said support member with a binder material to embed said positioned array of light sources and said associated circuitry within said binder material;

allowing said binder material to set within said mold containing said embedded array of light sources and said associated circuitry; and removing said mold and said support member, when said binder material is set, to obtain said concrete structure embedded with said positioned array of light sources and said associated circuitry, wherein said embedded array of light sources illuminates said concrete structure when said embedded array of light sources is powered on.

17. A method for constructing a concrete structure illuminated by light sources embedded in said concrete structure, said method comprising:

positioning an array of light sources of a predetermined configuration with associated circuitry on a support member, each of said light sources comprising a base and a lens housing in communication with and distal from said base;

positioning a mold around said positioned array of light sources and said associated circuitry on said support member;

filling said mold containing said positioned array of light sources and said associated circuitry on said support member with a binder material to embed said positioned array of light sources and said associated circuitry within said binder material;

allowing said binder material to set within said mold containing said embedded array of light sources and said associated circuitry;

removing said mold and said support member, when said binder material is set, to obtain said concrete structure embedded with said positioned array of light sources and said associated circuitry, wherein said embedded array of light sources illuminates said concrete structure when said embedded array of light sources is powered on; and creating a decorative pattern on said support member prior to said positioning of said array of light sources and said associated circuitry on said support member and said filling of said mold with said binder material on said support member to obtain a decorative upper layer in said concrete structure.

18. The method of claim 17, wherein said decorative pattern is one of a marbled pattern and a veined pattern created using decorative elements.

19. The method of claim 18, wherein said decorative elements comprise fine glass materials, coarse glass materials, ground glass materials, and any combination thereof.

* * * * *